United States Patent [19]

Eveson

[11] Patent Number: 4,683,742

[45] Date of Patent: Aug. 4, 1987

[54] COATING BILLETS FOR FORGING

[75] Inventor: Anthony C. Eveson, Reading, Great Britain

[73] Assignee: Radyne Limited, Wokingham, England

[21] Appl. No.: 841,295

[22] Filed: Mar. 19, 1986

[30] Foreign Application Priority Data

Mar. 19, 1985 [GB] United Kingdom ..... 8507093

[51] Int. Cl.[4] ..... B21J 3/00

[52] U.S. Cl. ..... 72/43; 72/46; 118/DIG. 4; 118/324

[58] Field of Search ..... 72/41, 42, 43, 44, 45, 72/46, 47, 342; 118/DIG. 4, 24, 324; 219/149, 150 R, 154; 427/420; 184/6.14, 12

[56] References Cited

U.S. PATENT DOCUMENTS 1,994,269 3/1935 Bonniksen ..... 427/420 X 3,069,535 12/1962 Vickers ..... 219/154

3,117,218 1/1964 Carlson ..... 219/150 R 3,479,208 11/1969 Dubble et al. ..... 118/324 X

FOREIGN PATENT DOCUMENTS 3026793 2/1982 Fed. Rep. of Germany ..... 427/420

60-56434 4/1985 Japan ..... 72/43

60-56435 4/1985 Japan ..... 72/43

*Primary Examiner*—E. Michael Combs

*Attorney, Agent, or Firm*—Solon B. Kemon

[57] ABSTRACT

To forge billets, the billets are fed end-to-end along a path which leads to a coating tank containing a lubricant and then through a heating station to a forging station. Within the coating tank, the line of billets is made to undergo a change of direction for example by passing over a hump in the feed path, such that an angular separation is created between adjacent end faces of successive billets. In this way, a better coating of the end faces of the billets is achieved.

8 Claims, 3 Drawing Figures

COATING BILLETS FOR FORGING

The conventional method of forging a billet involved heating the billet to a high temperature (about 1250° C.) before the billet-shaping step. The heating could be effected, for example by induction heating and for this purpose we have manufactured equipment in which a continuous column of billets is transported through a series of induction coils, each billet emerging from the last coil being at a temperature such that it can be transferred to the billet-shaping equipment.

In a recent development, the material is forged at a much lower temperature, normally 800° to 900° C.; this is clearly highly advantageous in energy consumption and in the length of the heating line. However, to be able to forge at these lower temperatures it is necessary to precoat each billet with a lubricant to aid the flow of the material in the forging dies. Typically, the lubricant is graphite-based. This lower-temperature forging produces a part which is finished to a very close tolerance and with a very high surface finish; in many instances, subsequent machining becomes unnecessary.

The most common method involves preheating each billet to a temperature of 100° to 200° C. and then coating the surface of the billet with the lubricant before reheating the billet to a higher temperature before its transport to the forging press; the preheating assists the drying of the coating. In one known system, each billet is fed into a slot in a wheel which then rotates to pass the billet through the lubricant in a tank, after which the billet is delivered to a conveyory for further heating.

Thus, although the lower-temperature forging has considerable advantages, it introduces mechanical complications into the billet feed system and it is the object of the present invention to reduce these complications.

A method according to the present invention comprises urging the billets end-to-end along a path which leads to a coating tank containing a lubricant and thence to a forging station, the line of billets undergoing a change of direction within the coating tank such that an angular separation is created between adjacent end faces of successive billets, whereby a better coating of the end faces is achieved, the method further comprising heating the lubricated billets to the forging temperature prior to their transfer to the forging station. As in the prior method, the billets may be preheated before coating to assist drying of the coating.

The invention also consists in apparatus for heating and lubricating billets for forging, the apparatus including means defining a transport path for the billets, means for feeding the billets end to end along the transport path to a coating station, for coating each billet with a lubricant, and thence through heating means to bring the lubricated billets up to the required temperature for transfer to the forging station, the coating station including a tank of lubricant through which the billet path passes and means within the tank for changing the direction of the line of billets to cause an angular separation of the end faces of successive billets to ensure a better coating of these end faces. We prefer to provide a preheating station before the coating station but alternatively a drying station using a hot air blower can be provided after the coating station.

In the preferred arrangement, the means within the tank for changing the direction of the line of billets comprises a roller or guide positioned to form a "hump" in the billet's transport path, such that a V-shaped opening is formed between adjacent end faces of successive billets passing over the hump. It will be appreciated, however, that the angular separation of the end faces can be in any plane; for example a V-shaped space could be created in a horizontal plane.

The invention thus overcomes the problem of satisfactory lubrication over the whole surface while providing a mechanically simple in-line billet feed system.

According to an advantageous feature of the invention, the coating tank is formed with an adjustable wall by means of which the effective length of the transport path within the lubricant can be varied.

In order that the invention may better understood, some examples of apparatus embodying the invention will now be described with reference to the accompanying drawings, in which.

Figure 1:
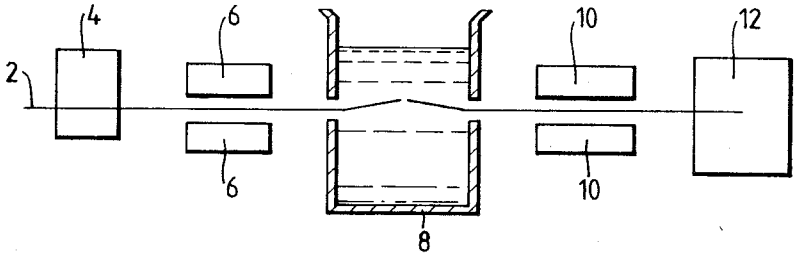
FIG. 1 shows diagrammatically the arrangement of heating and coating stations in a billet conveyor line embodying the invention.

In FIG. 1, the billets are initially transported along a feed path 2 up to a pair of pinch wheels at a driving station 4 by means of which they are pushed end-to-end through preheating induction coils 6 and a lubricating tank 8 to a further heating stage 10 and thence to the forging station 12.

Figure 2:
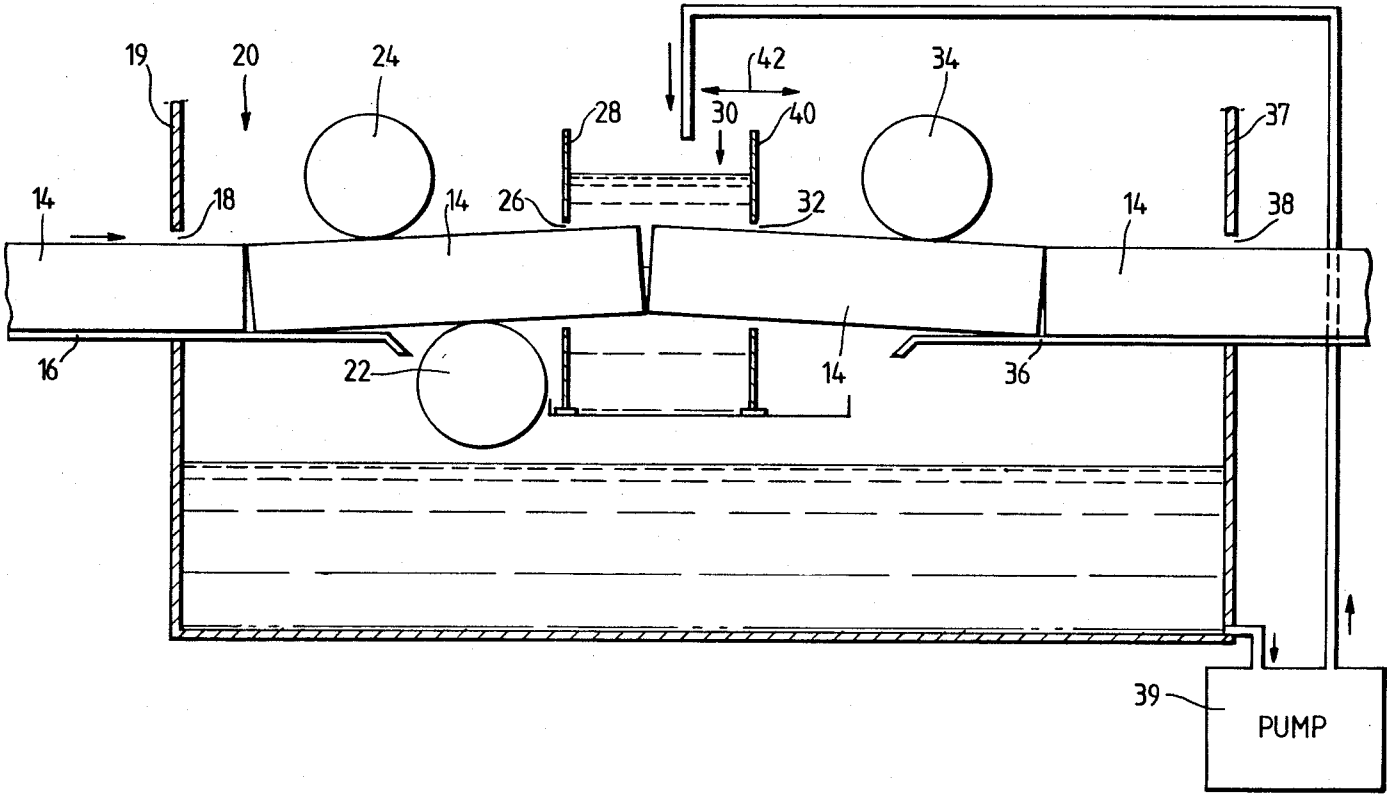
FIG. 2 is a cross-sectional view of a coating station in a first apparatus embodying the invention.

As shown in FIG. 2, in a first embodiment of the invention the line of moving billets passes along a guide plate 16 through an aperture 18 in the leading end wall 19 of an outer tank 20. Shortly after leaving the plate 16 within the tank 20, the leading end of each billet reaches a guide roller 22, the uppermost point of which is above the level of the upper surface of the guide plate 16. As a consequence, the billet whose leading end has contacted the guide roller 22 assumes an upwardly tilted position with its trailing end still on guide plate 16 and its lower and upper surfaces in contact respectively with the guide roller 22 and a roller 24. These rollers guide the leading end of the billet into an aperture 26 in the leading end wall 28 of an inner tank 30. The tank 30 contains the lubricant to a level above the level of the aperture 26. The leading end of the billet passes through the inner tank 30 and leaves through an exit aperture 32; thereafter, it is guided by a roller 34 on to an exit guide plate 36. The exit guide plate 36 leads the coated billet through an aperture 38 in the trailing end wall 37 of the outer tank 20.

As shown in the drawing, the position of the uppermost point of the roller 22 in relation to the level of the guide plate 16, and the position of the aperture 32 and the guide roller 34 in relation to the guide plate 36, cause a V-shaped opening to appear between a billet entering the tank and a billet leaving the tank. This ensures that the adjacent end surfaces of the two billets are properly coated by the lubricant. A further V-shaped opening appears between the billet leaving the coating tank 30 and the preceding billet and this assists in the drying of the lubricant.

It will be appreciated that lubricant flows out of the apertures 26 and 32, between the edges of these apertures and the billets; this lubricant falls into the outer tank and a pump 39 is provided to restore it to the inner tank and thus to maintain a predetermined level of lubricant over the billets. The entry of lubricant to the inner tank is effected by means of sprays under the liquid level to ensure continuous circulation of lubricant around the components and to prevent separation of the constituents forming the lubricant.

In the embodiment shown, the trailing end wall 40 of the inner tank is adjustable in the sense indicated by the arrow 42 to adjust the time for which the billet is in the lubricant, for any given feed speed. Such adjustment provides a more effective and more readily adjustable means for controlling the amount of coating than, for example, adjustment by controlling the flow of lubricant from sprays.

The walls 28 and 40 are replaceable to enable the use of walls with different aperture sizes for different sizes of billet.

If the inner tank is large enough a guide roller corresponding to or supplementing the guide rollers 22, 24 nd 34, may be arranged within the inner tank.

Figure 3:
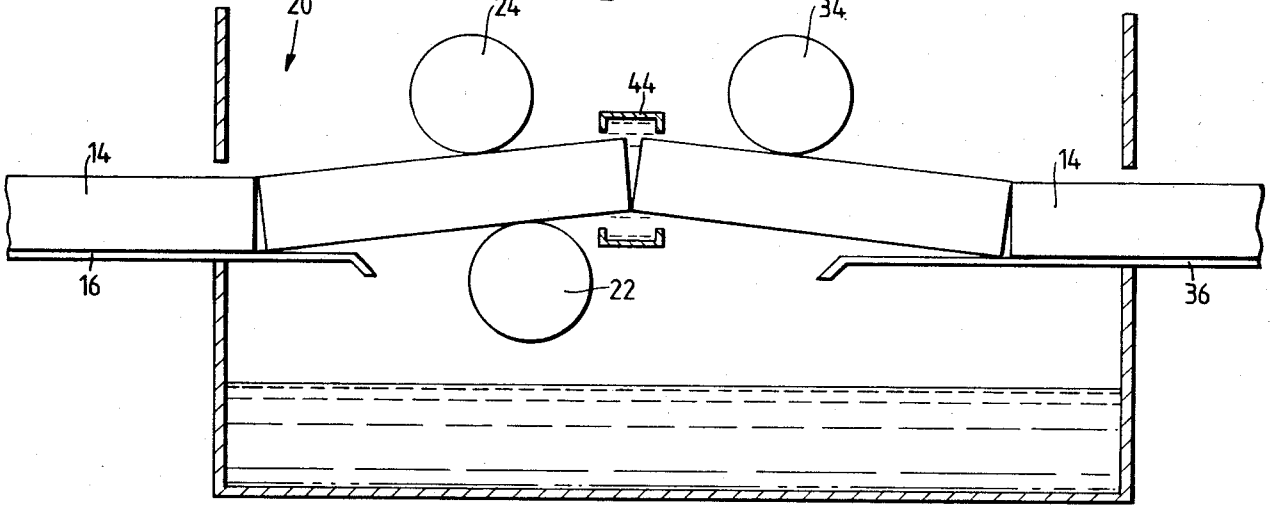
FIG. 3 illustrates the coating station in a second form of apparatus embodying the invention.

Finally, the embodiment shown in FIG. 3 is particularly suitable for large billets moved at a constant slow speed. In this case, the inner tank is formed by a cylinder 44 whose length is small in relation to its diameter. The degree of coating is now controlled by the flow of coating liquid to the ring. As in FIG. 2, the rollers 22, 24 and 34 guide the billets in such a manner that a V-shaped opening is formed between the end face of adjacent billets within the cylinder 44.

The degree of angular separation between such adjacent faces can of course be adjusted by raising or lowering the bottom guide roll 22.

As indicated earlier, the billets leaving the outer tank may pass through a hot-air drying station; however, if they have been preheated before entering the lubricating tank, it will probably not be necessary to employ a drying station following the lubricating tank.

I claim:

1. A method of heating and lubricating billets for forging comprising the steps of:

urging a line of billets end-to-end along a path towards a coating tank containing a lubricant and conveying the line of billets through the coating tank and thence to a forging station;

and modifying the direction of movement of the line of billets within the coating tank such that an angular separation is created between adjacent end faces of successive billets, whereby a better coating of the end faces is achieved;

and heating the lubricated billets to the forging temperature prior to their transfer to the forging station.

2. Apparatus for heating and lubricating billets for forging, the apparatus comprising:

means defining a transport path for the billets;

a coating station including a tank containing lubricant heating means to bring the lubricated billets up to the required temperature for transfer to the forging station, means for feeding a line of billets end-to-end along the transport path to the coating station and through the tank and heating means;

and means for changing the direction of the line of billets within the tank to cause an angular separation of the end faces of successive billets in the lubricant to ensure a better coating of these end faces.

3. Apparatus in accordance with claim 2, further comprising a preheating station before the coating station.

4. Apparatus in accordance with claim 2, further comprising a drying station using a hot-air blower after the coating station.

5. Apparatus in accordance with claim 2, in which the means for changing the direction of the line of billets comprises a roller or guide positioned to form a hump in the billet's transport path such that a V-shaped opening is formed between adjacent end faces of successive billets passing over the hump.

6. Apparatus in accordance with claim 2, in which the tank containing lubricant has an adjustable wall by means of which the effective length of the billet transport path within the lubricant can be varied.

7. Apparatus in accordance with claim 2, in which the lubricant-containing tank has apertures in its end walls, through which the billets enter and leave the tank, and the apparatus including a second tank within which the first tank is located, the second tank having apertures in its end walls through which the billets enter and leave the second tank; and including a pump for pumping lubricant from the base of the second tank to the first lubricant-containing tank to a level above the apertures in the walls of the first tank.

8. Apparatus in accordance with claim 7, in which the first tank is of annular form and is open at its inner cylindrical side to allow lubricant to pass from the annulus to the surfaces of billets passing through the aperture in the annulus.

* * * * *